US011257451B2

(12) United States Patent
Ju

(10) Patent No.: US 11,257,451 B2
(45) Date of Patent: Feb. 22, 2022

(54) DISPLAY PANEL AND DISPLAY DEVICE

(71) Applicant: WUHAN CHINA STAR OPTOELECTRONICS SEMICONDUCTOR DISPLAY TECHNOLOGY CO., LTD., Hubei (CN)

(72) Inventor: Rui Ju, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 303 days.

(21) Appl. No.: 16/494,374

(22) PCT Filed: May 5, 2019

(86) PCT No.: PCT/CN2019/085480
§ 371 (c)(1),
(2) Date: Sep. 16, 2019

(87) PCT Pub. No.: WO2020/206770
PCT Pub. Date: Oct. 15, 2020

(65) Prior Publication Data

US 2021/0327380 A1 Oct. 21, 2021

(30) Foreign Application Priority Data

Apr. 10, 2019 (CN) ..... 201910285472.9

(51) Int. Cl.
*G09G 3/36* (2006.01)

(52) U.S. Cl.
CPC ..... *G09G 3/3648* (2013.01); *G09G 2320/041* (2013.01)

(58) Field of Classification Search
CPC ..... G09G 3/3648; G09G 2320/041
See application file for complete search history.

(56) References Cited

U.S. PATENT DOCUMENTS

2017/0186354 A1* 6/2017 Zhang ..... G09G 3/2007
2019/0043424 A1 2/2019 Wang et al.

FOREIGN PATENT DOCUMENTS

CN 102915713 A 2/2013
CN 102982778 A 3/2013
CN 105099189 A 11/2015
CN 107066017 * 5/2017 ..... G05F 1/567
CN 107066017 A 8/2017
CN 107274836 A 10/2017

* cited by examiner

*Primary Examiner* — Jonathan A Boyd

(57) ABSTRACT

The present application relates to a display panel, including a thin film transistor, a first circuit, and a second circuit. The first circuit includes a first output terminal, a first and a second resistor in series with each other in order, and the first output terminal is configured to output a control voltage to a gate of the thin film transistor. The second circuit includes a third resistor and a compensation control switch in series with each other. When temperature is lower than a preset threshold temperature, the compensation control switch is conductive, and the third resistor is in parallel with the second resistor to increase the control voltage output from the first output terminal to the thin film transistor.

18 Claims, 2 Drawing Sheets

DISPLAY PANEL AND DISPLAY DEVICE

FIELD OF INVENTION

The present application relates to the technical field of display, and especially to a display panel and a display device.

BACKGROUND OF INVENTION

In application of liquid crystal panel driving circuits, gate driver on array (GOA) technology uses the array process of liquid crystal panels to fabricate a gate driving circuit on a thin film transistor (TFT) array substrate and realizes a driving approach by scanning gates column by column. A power management integrated circuit (PMIC) is a common circuit in a DC-to-DC converter of a display device, which is used to provide a gate turned-on voltage (VGH) to a TFT and turn on the TFT.

Under low temperature conditions, because electron mobility is low, the threshold voltage (VTH) of a TFT would increase. Therefore, under low temperature conditions, a higher VGH is required to turn on a TFT.

However, many conventional PMICs do not have a temperature compensation function for VGH, and when these PMICs are applied to a GOA circuit, because there is no temperature compensation for VGH, a VGH lower than the VTH of a TFT under low temperature conditions is likely to happen and therefore the problem of abnormal display or unable to display normally occurs.

SUMMARY OF INVENTION

The present application is to provide a display panel that includes a thin film transistor, a first circuit, and a second circuit. The first circuit includes a first output terminal, a first resistor, and a second resistor in series with each other in order, the first output terminal is configured to output a control voltage to a gate of the thin film transistor, a tap terminal is disposed between the first resistor and the second resistor, the tap terminal is input with a first preset voltage, and one terminal of the second resistor is grounded. The second circuit includes a third resistor and a compensation control switch in series with each other, one terminal of the second circuit is connected to the tap terminal, other terminal of the second circuit is grounded. When temperature is lower than a preset threshold temperature, the compensation control switch is conductive, and the third resistor is in parallel with the second resistor to increase the control voltage output from the first output terminal to the gate of the thin film transistor.

According to an embodiment of the present application, the display panel further includes a comparator and a third circuit. The third circuit is connected to the comparator and is configured to input a compared voltage to the comparator, and when the compared voltage is greater than a preset threshold voltage, the comparator inputs a conducting signal to the compensation control switch to make the compensation control switch conductive. The third circuit includes a temperature sensing device configured to control the compared voltage to vary according to temperature variation, and when the temperature is lower than the preset threshold temperature, the compared voltage is greater than the preset threshold voltage.

According to an embodiment of the present application, the compensation control switch is a field-effect transistor, the comparator is connected to a gate of the field-effect transistor, and the conducting signal is a voltage signal.

According to an embodiment of the present application, the comparator includes a fourth circuit including a fourth resistor and a fifth resistor, and wherein one terminal of the fourth resistor is input with a second preset voltage, other terminal of the fourth resistor is connected to one terminal of the fifth resistor, other terminal of the fifth resistor is grounded, and the preset threshold voltage is a voltage drop of the fifth resistor.

According to an embodiment of the present application, the fifth resistor is a variable resistor.

According to an embodiment of the present application, the temperature sensing device is a diode, the third circuit further includes a sixth resistor, one terminal of the sixth resistor is input with a third preset voltage, other terminal of the sixth resistor is connected to an anode of the diode, a cathode of the diode is grounded, and the compared voltage is a forward voltage drop of the diode.

According to an embodiment of the present application, the diode is multiple, and the multiple diodes are in series with each other.

According to an embodiment of the present application, the diode is a silicon diode.

According to an embodiment of the present application, the second circuit is multiple, the preset threshold temperature is multiple, and each of the second circuits corresponds to one of the preset threshold temperatures.

According to an embodiment of the present application, the compensation control switch is a thermoswitch.

In order to overcome the above mentioned problem, an embodiment of the present application further provides a display device that includes a display panel, and the display panel includes a thin film transistor, a first circuit, and a second circuit. The first circuit includes a first output terminal, a first resistor, and a second resistor in series with each other in order, the first output terminal is configured to output a control voltage to a gate of the thin film transistor, a tap terminal is disposed between the first resistor and the second resistor, the tap terminal is input with a first preset voltage, and one terminal of the second resistor is grounded. The second circuit includes a third resistor and a compensation control switch in series with each other, one terminal of the second circuit is connected to the tap terminal, other terminal of the second circuit is grounded. When temperature is lower than a preset threshold temperature, the compensation control switch is conductive, and the third resistor is in parallel with the second resistor to increase the control voltage output from the first output terminal to the gate of the thin film transistor.

According to an embodiment of the present application, the display panel further includes a comparator and a third circuit. The third circuit is connected to the comparator and is configured to input a compared voltage to the comparator, and when the compared voltage is greater than a preset threshold voltage, the comparator inputs a conducting signal to the compensation control switch to make the compensation control switch conductive. The third circuit includes a temperature sensing device configured to control the compared voltage to vary according to temperature variation, and when the temperature is lower than the preset threshold temperature, the compared voltage is greater than the preset threshold voltage.

According to an embodiment of the present application, the compensation control switch is a field-effect transistor, the comparator is connected to a gate of the field-effect transistor, and the conducting signal is a voltage signal.

According to an embodiment of the present application, the comparator includes a fourth circuit including a fourth resistor and a fifth resistor, and wherein one terminal of the fourth resistor is input with a second preset voltage, other terminal of the fourth resistor is connected to one terminal of the fifth resistor, other terminal of the fifth resistor is grounded, and the preset threshold voltage is a voltage drop of the fifth resistor.

According to an embodiment of the present application, the fifth resistor is a variable resistor.

According to an embodiment of the present application, the temperature sensing device is a diode, the third circuit further includes a sixth resistor, one terminal of the sixth resistor is input with a third preset voltage, other terminal of the sixth resistor is connected to an anode of the diode, a cathode of the diode is grounded, and the compared voltage is a forward voltage drop of the diode.

According to an embodiment of the present application, the diode is multiple, and the multiple diodes are in series with each other.

According to an embodiment of the present application, the diode is a silicon diode.

According to an embodiment of the present application, the second circuit is multiple, the preset threshold temperature is multiple, and each of the second circuits corresponds to one of the preset threshold temperatures.

According to an embodiment of the present application, the compensation control switch is a thermoswitch.

The beneficial effect of the present application is that, distinct from the conventional technology, the display panel according to the present application includes a thin film transistor, a first circuit, and a second circuit. The first circuit includes a first output terminal, a first resistor, and a second resistor in series with each other in order. The first output terminal is configured to output a control voltage to a gate of the thin film transistor, a tap terminal is disposed between the first resistor and the second resistor, the tap terminal is input with a first preset voltage, and one terminal of the second resistor is grounded. The second circuit includes a third resistor and a compensation control switch in series with each other, one terminal of the second circuit is connected to the tap terminal, and other terminal of the second circuit is grounded. When temperature is lower than a preset threshold temperature, the compensation control switch is conductive, and the third resistor is in parallel with the second resistor to increase the control voltage output from the first output terminal to the gate of the thin film transistor and realize temperature compensation for VGH under the condition of low temperature, and therefore to avoid a display panel having the problem of abnormal display or unable to display normally because of insufficient driving due to low temperature.

DESCRIPTION OF DRAWINGS

The accompanying figures to be used in the description of embodiments of the present application or prior art will be described in brief to more clearly illustrate the technical solutions of the embodiments or the prior art. The accompanying figures described below are only part of the embodiments of the present application, from which figures those skilled in the art can derive further figures without making any inventive efforts.

DETAILED DESCRIPTION OF PREFERRED EMBODIMENTS

The embodiments of the present application are described in detail hereinafter. Examples of the described embodiments are given in the accompanying drawings. It should be noted that, the following embodiments are intended to illustrate and interpret the present application, which shall not be construed as causing limitations to the present application. Similarly, the following embodiments are part of the embodiments of the present application and are not the whole embodiments, and all other embodiments those skilled in the art obtain without making any inventive efforts are within the scope protected by the present application.

Because power management integrated circuits (PMICs) do not have a temperature compensation function for a gate turned-on voltage (VGH), when a PMIC is applied to a gate driver on array (GOA) circuit, a VGH lower than a threshold voltage (VTH) of a thin film transistor (TFT) under a low temperature condition is likely to happen and therefore the problem of abnormal display or unable to display normally occurs. In order to overcome the above mentioned technical problem, the approach the present application adopts is adding a circuit to perform temperature compensation to the VGH of a PMIC under the condition of low temperature, and therefore to avoid a display panel having the problem of abnormal display or unable to display normally because of insufficient driving due to low temperature. The present application is described in detail hereinafter with accompanying drawings.

Figure 1:
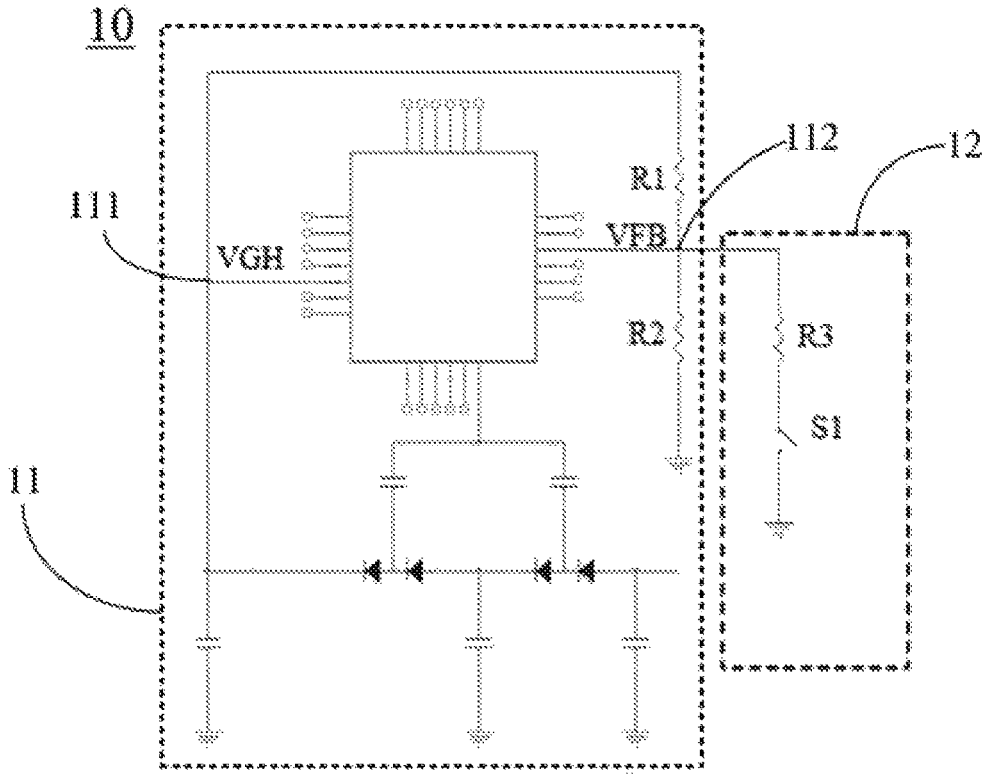
FIG. 1 is a structural schematic diagram of the display panel according to an embodiment of the present application.

Referring to FIG. 1, FIG. 1 is a structural schematic diagram of the display panel according to an embodiment of the present application. As shown in FIG. 1, the display panel 10 includes a thin film transistor (not shown), a first circuit 11, and a second circuit 12. The first circuit 11 includes a first output terminal 111, a first resistor R1, and a second resistor R2 in series with each other in order. The first output terminal 111 is configured to output a control voltage VGH to a gate of the thin film transistor, a tap terminal 112 is disposed between the first resistor R1 and the second resistor R2, the tap terminal 112 is input with a first preset voltage VFB, and one terminal of the second resistor R2 is grounded. The second circuit 12 includes a third resistor R3 and a compensation control switch S1 in series with each other, one terminal of the second circuit 12 is connected to the tap terminal 112, and other terminal of the second circuit 12 is grounded. When temperature is lower than a preset threshold temperature, the compensation control switch S1 is conductive, and the third resistor R3 is in parallel with the second resistor R2 to increase the control voltage VGH output from the first output terminal 111 to the gate of the thin film transistor.

Besides, when temperature increases from lower than a preset threshold temperature to higher than the preset threshold temperature, the compensation control switch S1 can change from a conductive state to an open state to stop temperature compensation of the control voltage VGH output from the first output terminal 111 to the gate of the thin film transistor.

The first circuit 11 is a PMIC configured to provide a gate turned-on voltage (VGH) to the TFT array substrate of the display panel 10 to turn on the thin film transistor. The second circuit 12 is configured to perform temperature compensation to the control voltage VGH output from the PMIC to the thin film transistor under a low temperature condition to avoid the display panel 10 having the problem of an abnormal display or unable to display normally because of insufficient driving due to low temperature.

In particular, under the condition of a normal temperature or when the second circuit 12 does not perform temperature compensation to VGH, the compensation control switch S1 is in an open state, current transmitting through the third resistor R3 is zero, and VGH=VFB*(1+R1/R2). For example, if VFB=1.25 volts, R1=232 KΩ, R2=10 KΩ, then VGH=1.25*232/10 volts=29 volts. When temperature is lower than a preset threshold temperature, the compensation control switch S1 is conductive, and because the resistance of the compensation control switch S1 when conductive is very low and negligible, the third resistor R3 is in parallel with the second resistor R2. The resistance when the second resistor R2 is in parallel with the third resistor R3 is R2*R3/(R2+R3), so the resistance of the second resistor R2 of the PMIC is equivalently reduced from R2 to R2*R3/(R2+R3), and after temperature compensation VGH=VFB*(1+R1/(R2*R3/(R2+R3))). For example, if R3=97.6 KΩ, then VGH=1.25*(1+232/(10*97.6/(10+97.6))) volts=33 volts. VGH is increased in comparison with that before compensation and therefore the problem of abnormal display because of insufficient driving due to low temperature can be avoid.

Figure 2:
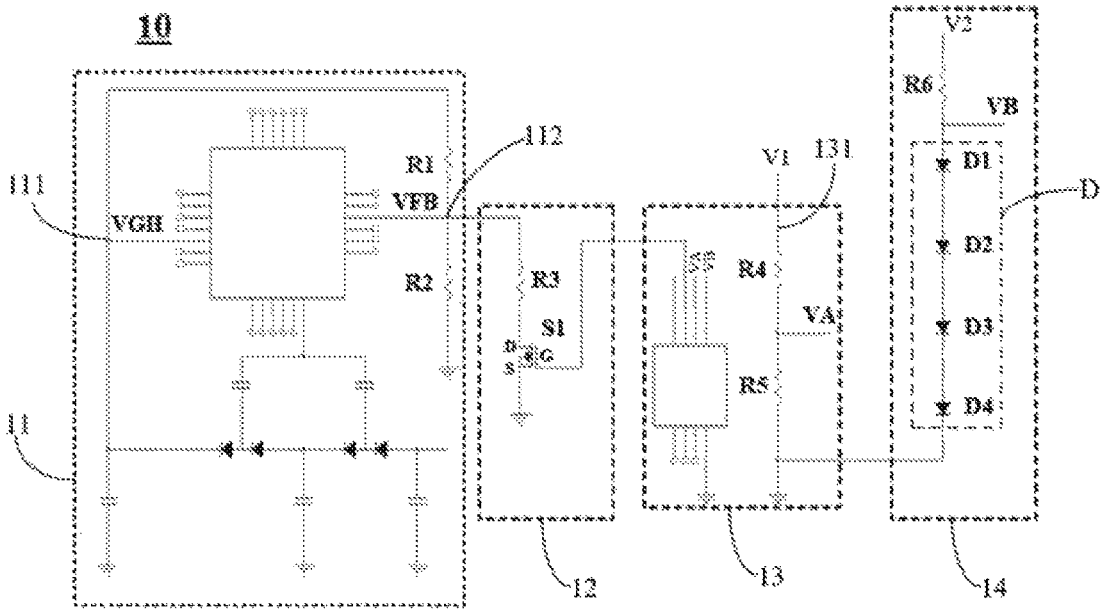
FIG. 2 is another structural schematic diagram of the display panel according to an embodiment of the present application.

Referring to FIG. 2, FIG. 2 is another structural schematic diagram according to an embodiment of the present application. As shown in FIG. 2, in one embodiment, the display panel 10 further includes a comparator 13 and a third circuit 14. The third circuit 14 is connected to the comparator 13 and is configured to input a compared voltage VB to the comparator 13. When the compared voltage VB is greater than a preset threshold voltage VA, the comparator 13 inputs a conducting signal to the compensation control switch S1 to make the compensation control switch S1 conductive. Correspondingly, when the compared voltage VB is less than or equal to the preset threshold voltage VA, the comparator 13 inputs an open signal to the compensation control switch S1 to make the compensation control switch S1 open. The third circuit 14 includes a temperature sensing device that controls the compared voltage VB to vary according to temperature variation. When temperature is lower than a preset threshold temperature, the compared voltage VB is greater than the preset threshold voltage.

The compensation control switch S1 can be a field-effect transistor, for example, a MOS transistor. The comparator 13 is connected to a gate G of the field-effect transistor S1, the conducting signal is a voltage signal, and the voltage value of the voltage signal is greater than the threshold voltage of the field-effect transistor S1. Correspondingly, the open signal is also a voltage signal, and the voltage value of the voltage signal is less than the threshold voltage of the field-effect transistor S1.

In one embodiment, as shown in FIG. 2, the comparator 13 includes a fourth circuit 131 including a fourth resistor R4 and a fifth resistor R5, wherein one terminal of the fourth resistor R4 is input with a second preset voltage V2, other terminal of the fourth resistor R4 is connected to one terminal of the fifth resistor R5, other terminal of the fifth resistor R5 is grounded, the preset threshold voltage VA is a voltage drop of the fifth resistor R5, and according to Ohm's law, VA=V1*R5/(R4+R5).

The preset threshold temperature corresponds to the voltage drop of the fifth resistor R5. For example, when the second preset voltage V1 is fixed, by adjusting the resistance of the fourth resistor R4 and the fifth resistor R5, the voltage drop of the fifth resistor R5 can be adjusted and the corresponding preset threshold temperature can also be adjusted. Another example, the fifth resistor R5 can be a variable resistor, and the preset threshold temperature can be adjusted by adjusting the resistance of the fifth resistor R5.

In particular, if the required preset threshold temperature is zero degree Celsius, first, a compared voltage VB output by the third circuit 14 under the condition of zero degree Celsius needs to be obtained, and then by adjusting the resistance of the fourth resistor R4 or the fifth resistor R5, the voltage drop of the fifth resistor R5 is set equal to the compared voltage VB under the condition of zero degree Celsius. In this way, when the operating temperature of the display panel 10 is lower than zero degree Celsius, the corresponding compared voltage VB will be greater than a preset threshold voltage VA and the comparator 13 will output a conducting signal to the compensation control switch S1 to make the compensation control switch S1 conductive, and therefore low temperature compensation is performed to VGH output from the first circuit 11.

In an alternative embodiment, as shown in FIG. 2, the temperature sensing device is a diode D, the third circuit 14 further includes a sixth resistor R6, one terminal of the sixth resistor R6 is input with a third preset voltage V2, other terminal of the sixth resistor R6 is connected to an anode of the diode D, a cathode of the diode D is grounded, and the compared voltage VB is a forward voltage drop of the diode D. The forward voltage drop of the diode D increases as temperature decreases, and when temperature is lower than a preset threshold temperature, the voltage drop of the diode D is equal to the aforementioned preset threshold voltage VA. Furthermore, the diode D is advantageously a silicon diode for the voltage drop of a silicon diode is greater than that of other diodes such as a germanium diode and that is advantageous to the precision of temperature compensation.

In particular, the diode D can be multiple, and the multiple diodes D are in series with each other. For example, the number of the diodes D is four, and the four diodes (D1, D2, D3, D4) are in series with each other. The compared voltage VB is the total voltage drop of the four diodes (D1, D2, D3, D4). Another example, if the four diodes (D1, D2, D3, D4) are silicon diodes and under the condition of a normal temperature (25 degrees Celsius), the voltage drop of each of the diodes is 0.7 volts, then VB is 2.8 volts. Furthermore, when temperature decreases from a normal temperature to zero degree Celsius, according to the specification of the selected silicon diodes, such as the voltage drop of a silicon diode increases 2.2 millivolts per degree Celsius temperature decreasing, VB becomes 3.02 volts.

Figure 3:
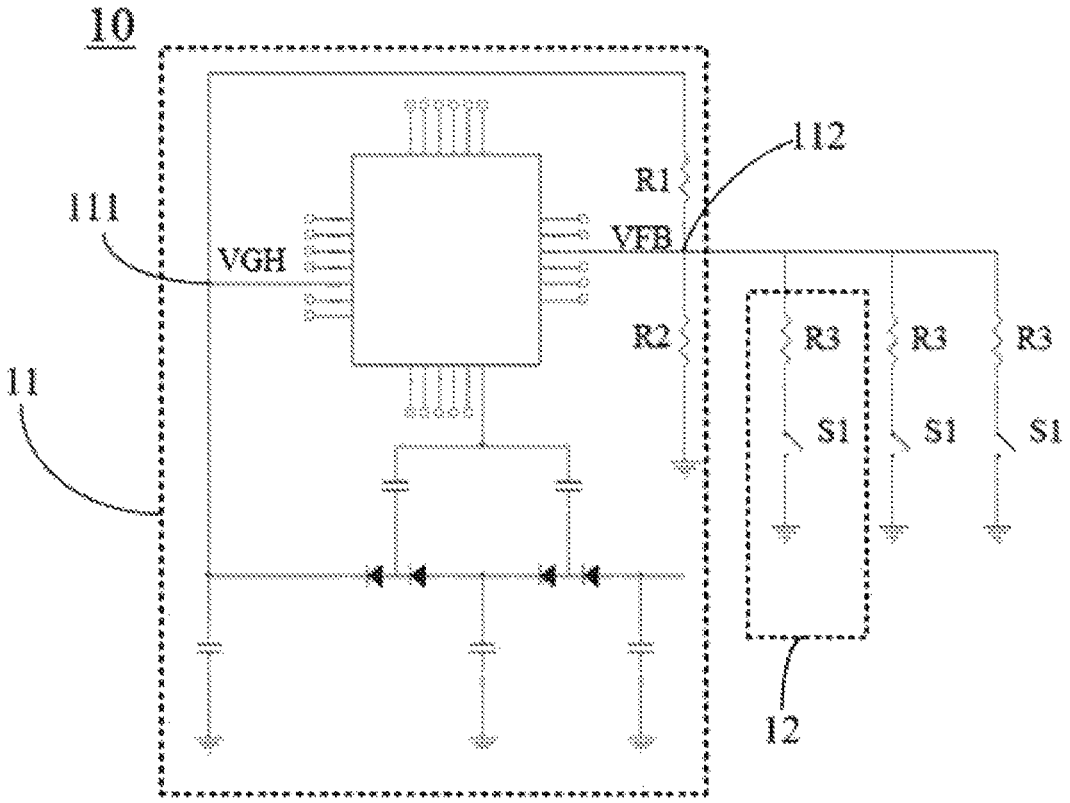
FIG. 3 is still another structural schematic diagram of the display panel according to an embodiment of the present application.

In another alternative embodiment, as shown in FIG. 3, the second circuit 12 can be multiple, the preset threshold temperature is multiple, and each of the second circuits 12 corresponds to one of the preset threshold temperatures. For example, the number of the second circuits 12 is three, and the corresponding preset threshold temperatures are zero degree Celsius, five degrees below zero Celsius, and ten degrees below zero Celsius, respectively. When temperature is lower than zero degree Celsius and greater than or equal to five degrees below zero Celsius, only one compensation control switch S1 of the second circuits 12 is conductive, when temperature is lower than five degrees below zero Celsius and greater than or equal to ten degrees below zero Celsius, only two compensation control switches S1 of the second circuits 12 are conductive, and when temperature is lower than ten degrees below zero Celsius, all compensation control switches S1 of the three second circuits 12 are conductive. In this way, multiple temperature intervals can be distinguished to compensate VGH output from the first circuit, and thereby temperature compensation value for VGH is incrementally increased for decreasing power consumption.

The compensation control switch S1 can be a thermo-switch conductive at low temperature, and can also be a field-effect transistor. When the compensation control switch S1 is a field-effect transistor, the compensation control switches S1 subject to each of the second circuits 12 can correspondingly and independently configure the comparator 13 and the third circuit 14 in the above mentioned embodiment, or the compensation control switches S1 of each of the second circuits 12 can correspondingly and independently configure the comparator 13 in the above mentioned embodiment, and all the comparators 13 share one third circuit 14, to realize controlling the intended compensation control switch S1 conductive when temperature is lower than corresponding preset threshold temperatures.

Distinct from the conventional technology, the display panel of the present embodiment includes a thin film transistor, a first circuit, and a second circuit. The first circuit includes a first output terminal, a first resistor, and a second resistor in series with each other in order. The first output terminal is configured to output a control voltage to a gate of the thin film transistor, a tap terminal is disposed between the first resistor and the second resistor, the tap terminal is input with a first preset voltage, and one terminal of the second resistor is grounded. The second circuit includes a third resistor and a compensation control switch in series with each other, one terminal of the third resistor and the compensation control switch in series with each other is connected to the tap terminal, and other terminal of the third resistor and the compensation control switch is grounded. When temperature is lower than a preset threshold temperature, the compensation control switch is conductive, and the third resistor is in parallel with the second resistor to increase the control voltage output from the first output terminal to the gate of the thin film transistor and realize temperature compensation for VGH under the condition of low temperature, and therefore to avoid a display panel having the problem of abnormal display or unable to display normally because of insufficient driving due to low temperature.

Figure 4:
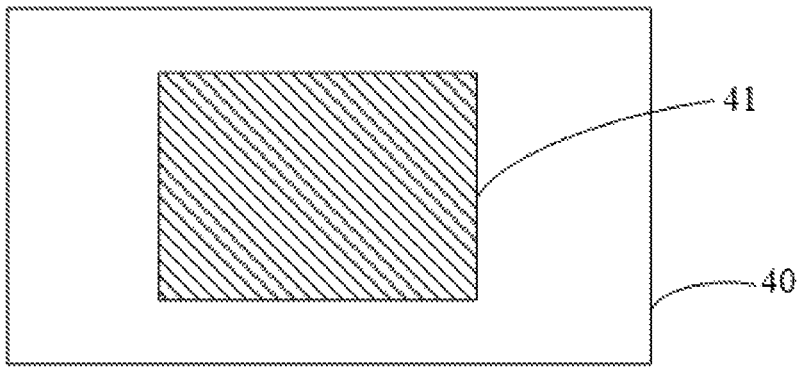
FIG. 4 is a structural schematic diagram of the display device according to an embodiment of the present application.

Referring to FIG. 4, FIG. 4 is a structural schematic diagram of the display device according to an embodiment of the present application. As shown in FIG. 4, the display device 40 includes the display panel 41 of any of the above described embodiments.

The display panel 41 includes a thin film transistor, a first circuit, and a second circuit. The first circuit includes a first output terminal, a first resistor, and a second resistor in series with each other in order. The first output terminal is configured to output a control voltage to a gate of the thin film transistor, a tap terminal is disposed between the first resistor and the second resistor, the tap terminal is input with a first preset voltage, and one terminal of the second resistor is grounded. The second circuit includes a third resistor and a compensation control switch in series with each other, one terminal of the second circuit is connected to the tap terminal, and other terminal of the second circuit is grounded. When temperature is lower than a preset threshold temperature, the compensation control switch is conductive, and the third resistor is in parallel with the second resistor to increase the control voltage output from the first output terminal to the gate of the thin film transistor.

Distinct from the conventional technology, the display panel of the present embodiment includes a thin film transistor, a first circuit, and a second circuit. The first circuit includes a first output terminal, a first resistor, and a second resistor in series with each other in order. The first output terminal is configured to output a control voltage to a gate of the thin film transistor, a tap terminal is disposed between the first resistor and the second resistor, the tap terminal is input with a first preset voltage, and one terminal of the second resistor is grounded. The second circuit includes a third resistor and a compensation control switch in series with each, other, one terminal of the second circuit is connected to the tap terminal, and other terminal of the second circuit is grounded. When temperature is lower than a preset threshold temperature, the compensation control switch is conductive, and the third resistor is in parallel with the second resistor to increase the control voltage output from the first output terminal to the gate of the thin film transistor and realize temperature compensation for VGH under the condition of low temperature, and therefore to avoid a display panel having the problem of abnormal display or unable to display normally because of insufficient driving due to low temperature.

The present application has been described with a preferred embodiment thereof. The preferred embodiment is not intended to limit the present application, and it is understood that many changes and modifications to the described embodiment can be carried out without departing from the scope and the spirit of the disclosure that is intended to be limited only by the appended claims.

What is claimed is:

1. A display panel, comprising a thin film transistor, a first circuit, a second circuit, a comparator, and a third circuit;

wherein the first circuit comprises a first output terminal, a first resistor, and a second resistor in series with each other in order, the first output terminal is configured to output a control voltage to a gate of the thin film transistor, a tap terminal is disposed between the first resistor and the second resistor, the tap terminal is input with a first preset voltage, and one terminal of the second resistor is grounded;

wherein the second circuit comprises a third resistor and a compensation control switch in series with each other, one terminal of the second circuit is connected to the tap terminal, other terminal of the second circuit is grounded, and when temperature is lower than a preset threshold temperature, the compensation control switch is conductive, and the third resistor is in parallel with the second resistor to increase the control voltage output from the first output terminal to the gate of the thin film transistor, and wherein the third circuit is connected to the comparator and is configured to input a compared voltage to the comparator, and when the compared voltage is greater than a preset threshold voltage, the comparator inputs a conducting signal to the compensation control switch to make the compensation control switch conductive;

wherein the third circuit comprises a temperature sensing device configured to control the compared voltage to vary according to temperature variation, and when the temperature is lower than the preset threshold temperature, the compared voltage is greater than the preset threshold voltage.

2. The display panel as claimed in claim 1, wherein the compensation control switch is a field-effect transistor, the comparator is connected to a gate of the field-effect transistor, and the conducting signal is a voltage signal.

3. The display panel as claimed in claim 1, wherein the comparator comprises a fourth circuit comprising a fourth resistor and a fifth resistor, and wherein one terminal of the fourth resistor is input with a second preset voltage, other terminal of the fourth resistor is connected to one terminal of the fifth resistor, other terminal of the fifth resistor is grounded, and the preset threshold voltage is a voltage drop of the fifth resistor.

4. The display panel as claimed in claim 3, wherein the fifth resistor is a variable resistor.

5. The display panel as claimed in claim 1, wherein the temperature sensing device is a diode, the third circuit further comprises a sixth resistor, one terminal of the sixth resistor is input with a third preset voltage, other terminal of the sixth resistor is connected to an anode of the diode, a cathode of the diode is grounded, and the compared voltage is a forward voltage drop of the diode.

6. The display panel as claimed in claim 5, wherein the diode is multiple, and the multiple diodes are in series with each other.

7. The display panel as claimed in claim 5, wherein the diode is a silicon diode.

8. The display panel as claimed in claim 1, wherein the second circuit is multiple, the preset threshold temperature is multiple, and each of the second circuits corresponds to one of the preset threshold temperatures.

9. The display panel as claimed in claim 1, wherein the compensation control switch is a thermoswitch.

10. A display device, comprising a display panel, wherein the display panel comprises a thin film transistor, a first circuit, a second circuit, a comparator, and a third circuit;

wherein the first circuit comprises a first output terminal, a first resistor, and a second resistor in series with each other in order, the first output terminal is configured to output a control voltage to a gate of the thin film transistor, a tap terminal is disposed between the first resistor and the second resistor, the tap terminal is input with a first preset voltage, and one terminal of the second resistor is grounded;

wherein the second circuit comprises a third resistor and a compensation control switch in series with each other, one terminal of the second circuit is connected to the tap terminal, other terminal of the second circuit is grounded, and when temperature is lower than a preset threshold temperature, the compensation control switch is conductive, and the third resistor is in parallel with the second resistor to increase the control voltage output from the first output terminal to the gate of the thin film transistor, and wherein the third circuit is connected to the comparator and is configured to input a compared voltage to the comparator, and when the compared voltage is greater than a preset threshold voltage, the comparator inputs a conducting signal to the compensation control switch to make the compensation control switch conductive;

wherein the third circuit comprises a temperature sensing device configured to control the compared voltage to vary according to temperature variation, and when the temperature is lower than the preset threshold temperature, the compared voltage is greater than the preset threshold voltage.

11. The display device as claimed in claim 10, wherein the compensation control switch is a field-effect transistor, the comparator is connected to a gate of the field-effect transistor, and the conducting signal is a voltage signal.

12. The display device as claimed in claim 10, wherein the comparator comprises a fourth circuit comprising a fourth resistor and a fifth resistor, and wherein one terminal of the fourth resistor is input with a second preset voltage, other terminal of the fourth resistor is connected to one terminal of the fifth resistor, other terminal of the fifth resistor is grounded, and the preset threshold voltage is a voltage drop of the fifth resistor.

13. The display device as claimed in claim 12, wherein the fifth resistor is a variable resistor.

14. The display device as claimed in claim 10, wherein the temperature sensing device is a diode, the third circuit further comprises a sixth resistor, one terminal of the sixth resistor is input with a third preset voltage, other terminal of the sixth resistor is connected to an anode of the diode, a cathode of the diode is grounded, and the compared voltage is a forward voltage drop of the diode.

15. The display device as claimed in claim 14, wherein the diode is multiple, and the multiple diodes are in series with each other.

16. The display device as claimed in claim 14, wherein the diode is a silicon diode.

17. The display device as claimed in claim 10, wherein the second circuit is multiple, the preset threshold temperature is multiple, and each of the second circuits corresponds to one of the preset threshold temperatures.

18. The display device as claimed in claim 10, wherein the compensation control switch is a thermoswitch.

* * * * *